United States Patent [19]

DeRoche

[11] Patent Number: 4,471,791

[45] Date of Patent: Sep. 18, 1984

[54] HAIR SHAPING METHOD AND APPARATUS

[75] Inventor: Donald R. DeRoche, Farmington, Mich.

[73] Assignee: Olivia D. Rusenstrom

[21] Appl. No.: 20,805

[22] Filed: Mar. 15, 1979

Related U.S. Application Data

[63] Continuation of Ser. No. 774,775, Mar. 7, 1977, abandoned.

[51] Int. Cl.[3] ..... A45G 24/36

[52] U.S. Cl. ..... 132/9

[58] Field of Search ..... 132/9, 45 R, 85, 11 R; 30/216, 415, 131, 133, 221

[56] References Cited

U.S. PATENT DOCUMENTS

| | | | |
|---|---|---|---|
| 1,723,828 | 8/1929 | Von Sandt | 30/133 |
| 2,292,453 | 8/1942 | LaMere | 30/221 |
| 3,012,323 | 12/1961 | Thompson | 32/33 |
| 3,035,346 | 5/1962 | Campbell | 30/21 X |
| 3,134,382 | 5/1964 | Broman | 132/45 R |
| 3,353,265 | 11/1967 | Mendoza | 30/133 |
| 3,383,765 | 5/1968 | Meltzer | 30/133 X |

FOREIGN PATENT DOCUMENTS

| | | | |
|---|---|---|---|
| 116706 | 3/1930 | Fed. Rep. of Germany | 132/45 R |

*Primary Examiner*—Gregory E. McNeill

*Attorney, Agent, or Firm*—Barnes, Kisselle, Raisch, Choate, Whittemore & Hulbert

[57] ABSTRACT

Method and apparatus for shaping human hair to provide a particular hairstyling effect wherein hair which has been moistened is shaped by moving a cutting blade through the moist hair to razor cut and/or thin or blunt the hair. The blade is manipulated such that the hair is trained into a predetermined set position while the same is being cut and/or thinned. Simultaneously, a stream of hot or cold air is directed across the blade generally in the direction of movement of the blade. The air stream moves out ahead of the cutting blade after sweeping the same to thereby help train the hair into the aforementioned set position while at least semi-drying the moisture from the hair, whereby upon completion of the conjoint razor cutting and blowing, the hair is shaped into final placement for the desired hairstyle.

4 Claims, 10 Drawing Figures

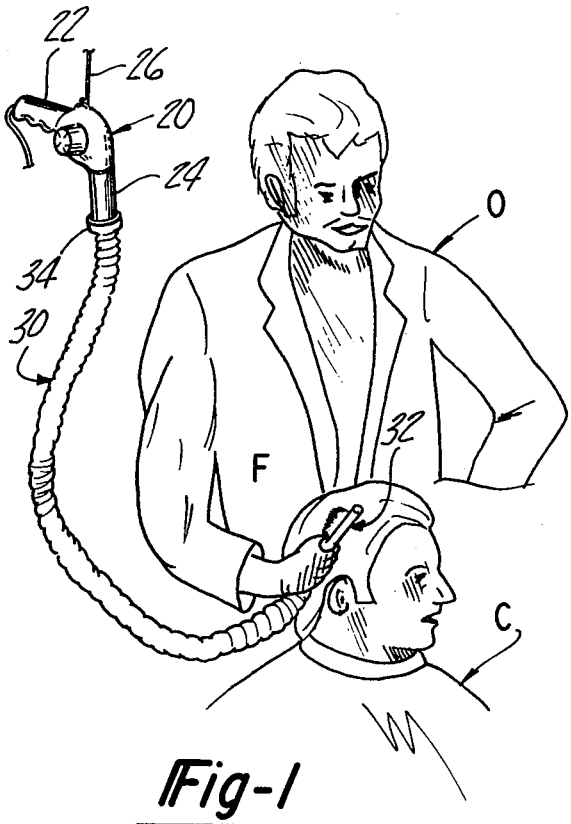
Fig-1
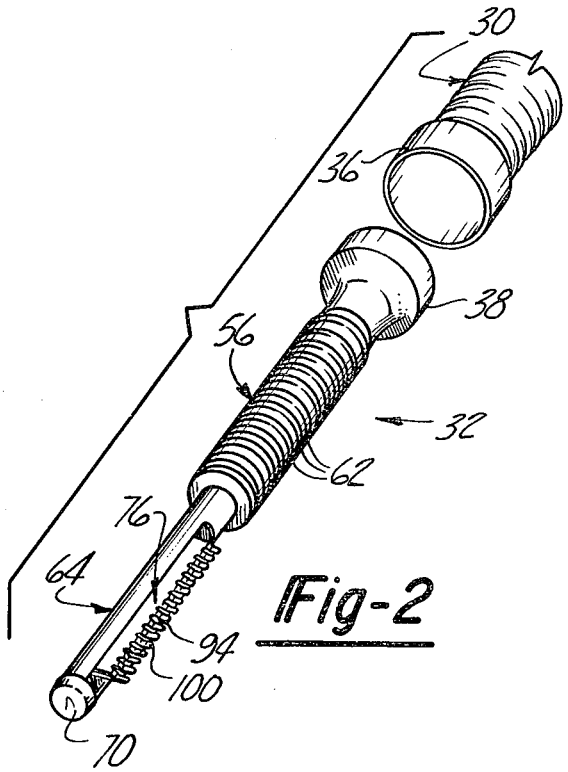
Fig-2
Fig-3
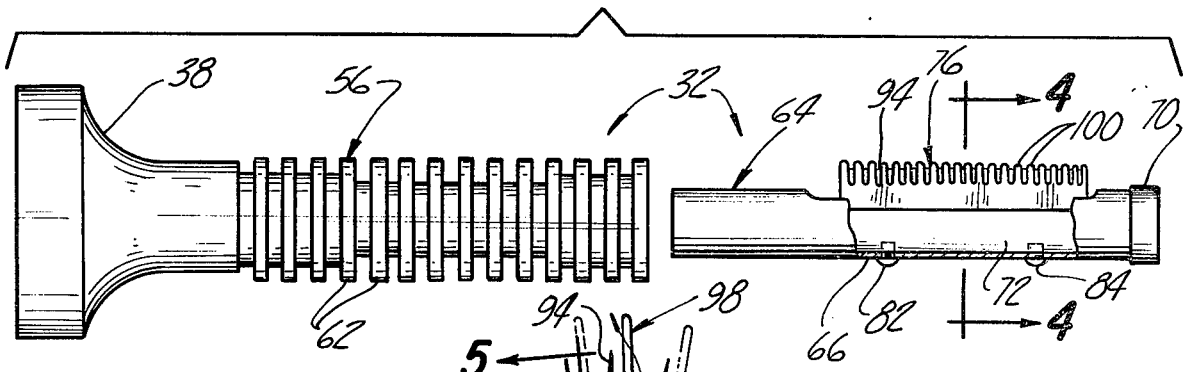
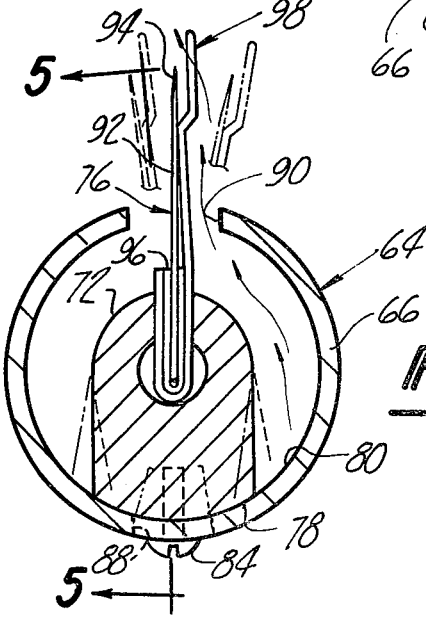
Fig-4

HAIR SHAPING METHOD AND APPARATUS

This application is a continuation of Ser. No. 774,775, now abandoned, filed 3-7-77.

This invention relates to the art of cosmetology, and more particularly to a method of shaping human hair to provide a variety of styling effects for the hair on the head, and to hair shaping apparatus for performing the method of the invention.

Hitherto, it has been common practice in styling of both male and female hairdos in professional beauty shops and hairstyling salons to perform what is known as "hair shaping" as a series of separate and discrete operations. Thus, in general, to perform hair shaping, the cosmetologist or beautician has first shampooed and then rinsed the customer's hair, and then a razor cutting operation is performed on the hair with a conventional hand-held shaping device, such as the hair shaper sold commercially by Weck Co. of New York, N.Y.

This razor cutting is done while the hair is still wet to facilitate the cutting action of the razor blade and to prevent pulling or snagging of the blade which would otherwise occur if the hair were dry. In the case of longer hair, as with feminine hairdos, the hair is next set with rollers as required to impart the appropriate curl and desired pattern and shape to the hair, and then the hair is dried under a dryer. Finally, the hair is combed out after being dried to the final desired effect.

In the case of shorter hairdos, as customarily encountered in men's hairstyling, after the razor cutting step a further separate step has been required, namely a combined blowing and combing of the hair. This is done by holding an electrically powered hair dryer in one hand and a comb in the other, and manipulating the drying blower and comb to simultaneously dry the hair as the same is combed into final position. In this step, a certain amount of separation or fluffing is imparted to the hair to add body as may be desired in the particular hair style. In either case, the series of discreet and sequential steps required hitherto have, of course, increased the time required for the complete hair shaping treatment and hence the cost of the services performed in achieving the desired hairstyling effect.

It is an object of the present invention to provide a new and improved cosmetological method of shaping human hair, whether it be long or short, male or female, which results in considerable time and cost savings, enables a greater variety of styles and effects to be achieved, reduces the problem of split ends of the hair sometimes encountered in razor cutting, reduces the irritation and annoyance to the customer and eliminates the blade cleaning operation of the operator hitherto encountered with the hair cuttings generated during the hair shaping operation, and enables the use of specially formulated fast setting lotions in combination with the razor cutting and drying action to further reduce the time required to achieve the ultimate hairdo as well as to provide a hairdo which will retain its set for a longer period of time.

Another object of the present invention is to provide an improved hair shaping apparatus and device for performing the aforementioned hair shaping method of the invention which is economical to manufacture, reliable and durable in use, lightweight, enables maximum flexibility and versatility with hand-held use by the beautician or hairstylist employing the device in the method of the invention, readily convertible from right-hand to left-hand operation depending upon the needs of the operator, enables the razor cutting blades to be changed as required and which is safe to use from the standpoint of both the operator and customer.

Other objects, features and advantages of the method and apparatus of the present invention will become apparent from the following detailed description taken in conjunction with the accompanying drawings, which have been drawn to scale from an actual working prototype, and wherein:

FIG. 1 is a perspective view illustrating a hairstylist performing the method of the invention using an exemplary but preferred embodiment of the improved hair shaping apparatus of the invention on the head of hair of a customer.

FIG. 2 is an exploded perspective view of the hair shaping tool or implement of the invention with the same shown separated from the flexible conduit which connects the hand-held implement to a remote source of pressurized hot or cold air.

FIG. 3 is an exploded elevational view of the head and handle portions of the hair shaping implement shown separated from one another.

FIG. 4 is a vertical cross-sectional view taken on the line 4—4 of FIG. 3.

Figure 5:
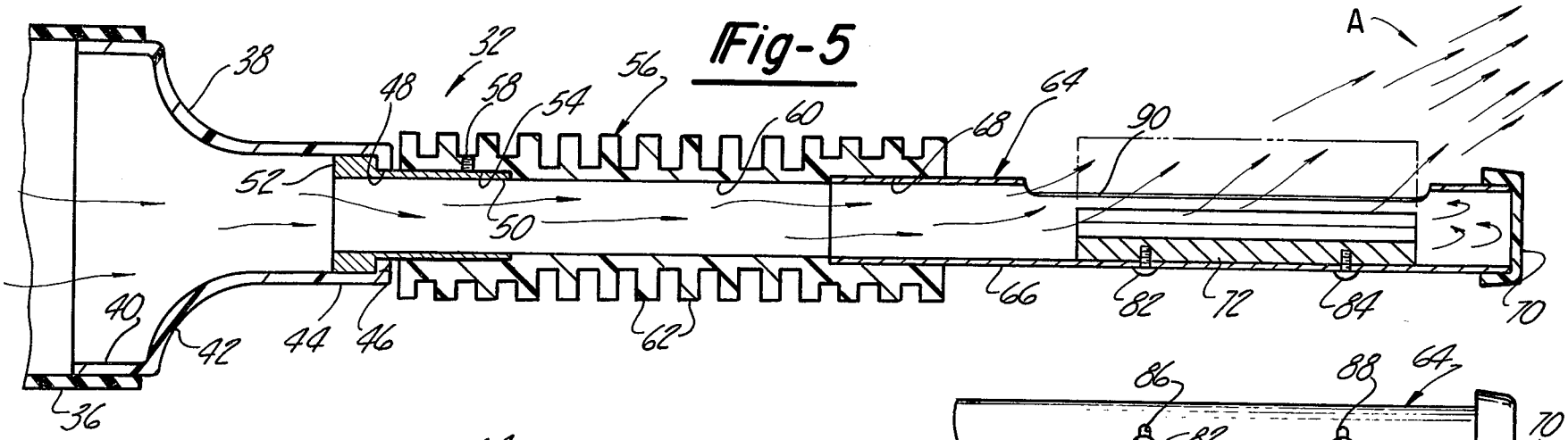
FIG. 5 is a vertical cross-sectional view taken on the line 5—5 of FIG. 4.

Referring in more detail to the accompanying drawings, the improved hair shaping apparatus and implements of the invention will first be described, and the method of the invention will become apparent from the subsequent description of the manner in which the hair shaping apparatus is to be employed in practicing the invention. As best seen in FIG. 1, the hair shaping apparatus of the invention preferably includes a source of a hot or cold air stream having a relatively high velocity flow under low pressure, such as a portable hand-held professional styling dryer 20. One example of such a dryer is that sold under the trademark "SOLIS", Model 68, Type 200, which is manufactured in Switzerland and imported by Rolf Brauchli, Inc., of Chicago, Ill. Dryer 20 includes a handle 22 and cylindrical output nozzle 24, and is equipped with an electric motor driving a small blower, along with an electric heating element powered from a 110-volt, 60-cycle AC current source and having a power rating of anywhere from 200 watts up to 1500 watts. These commercially available blower dryer units are capable of producing a relatively high velocity low pressure flow of air at any desired temperature ranging from ambient (usually room temperature) on up to say 200° F. For convenience in practicing the present invention, the styling dryer 20 may be suspended by a cord 26 from any suitable overhead suspension device, or may be hung on a wall hook close to the operator's styling station.

The hair shaping apparatus also preferably includes a conduit 30 connecting an air source 20 to a hand-held hair shaping implement 32 of the invention. Conduit 30 may comprise commercially available lightweight plastic flexible hose such as that currently provided with conventional portable hair dryers and the like. This type of hose has a high degree of flexibility and ranges from one to one and one-half inches in diameter, and is capable of withstanding air temperatures of to say 300° F. to 400° F. Conduit 30 may be any suitable length as desired to give maximum flexibility and ease of handling to implement 32, and ordinarily will range from six to twelve feet in length. One end of conduit 30 is provided with the usual plastic slip-on collar 34 to removably attach conduit 30 to the nozzle 24 of dryer 20.

As best seen in FIGS. 2 and 5, the other end of conduit 30, remote from dryer 20, is provided with a similar collar 36 adapted to be telescopically engaged, for a slip-on frictional fit, onto a coupling element 38. Coupler 38 is provided as part of implement 32 and has a large diameter cylindrical end portion 40 adapted to slidably receive collar 36 thereon, and an inwardly tapering curved neck portion 42 which flares into a reduced diameter cylindrical end portion 44 which in turn terminates at an inwardly turned flange 46. Flange 46 defines an opening 48 in which a metal sleeve 50 is received with a sliding fit. Sleeve 50 has an external annular flange 52 rotatable within neck 44 and captured behind coupler flange 46. Sleeve 50 is received with a sliding friction fit in a counterbore 54 (FIG. 5) formed in one end of a handle 56 of implement 32 and is fastened in place by a set screw 58. Handle 56 preferably comprises an injection molded plastic part made of a suitable heat resistant plastic material, such as Bakelite, having a hollow through bore 60 and axially spaced external annular ribs 62 which serve to space the operator's hand radially away from bore 60 while gripping implement 32 and which also serve as a cooling surface when the hot air is being forced through bore 60 to thereby enable handle 56 to be comfortably hand held for prolonged periods despite high air temperatures.

Hair shaping implement 32 also includes a cutting and drying head 64 comprising a hollow tubular housing 66 received at one end with a frictional retaining fit in a counterbore 68 of handle 56, a cap 70 snapped over the open opposite end of housing 66 with a frictional retaining fit and a blade holder 72 removably mounted within the interior of housing 66.

Figure 6:
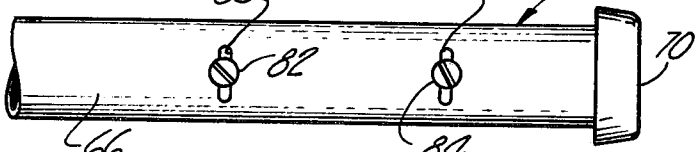
FIG. 6 is a bottom plan view of a portion of the head of the hair shaping implement.

Holder 72 may comprise a long and narrow brass block slotted throughout its length to provide a keyhole shaped passage 74 (FIGS. 4 and 5) adapted to slidably receive endwise therein a commercially available hair shaper blade and guard subassembly 76. Holder 72 has a suitably curved undersurface 78 (FIG. 4) which seats on the curved interior wall 80 of housing 66, and is adjustably secured in place therein by a pair of round head machine screws 82 and 84 inserted through associated transverse slots 86 and 88 in housing 66 (FIGS. 4 and 6). Slots 86 and 88 are of sufficient length to permit holder 72 to be shifted sideways between the extreme adjusted positions shown in phantom in FIG. 4 to thereby adjust the angular orientation of the blade and guard assembly 76 relative to housing 66 and thus the position of the blade-guard assembly 76 relative to an elongated slot or opening 90 in housing 66 through which the blade-guard 76 protrudes.

The blade-guard 76 preferably comprises any of the well-known commercially available hair shaper razor cutting attachments. One such blade and guard subassembly 76 suitable for use in the shaping implement 32 of the invention is the hair shaper blade sold under the trademark PERSONNA and manufactured by American Safety Razor Company of Staunton, Va. Blade-guard 76 thus consists of a single edge razor blade 92 (FIG. 4) having a very sharp straight cutting edge 94 extending along one longitudinal edge thereof and having a U-shaped sheet metal backbone part 96 clenched over the opposite longitudinal edge of the blade. Blade 92 in turn is permanently fastened in a guard 98 which has one edge clenched over and surrounding backbone 96. The outer free edge of guard 98 is fashioned into a comb-like protrusion so as to project adjacent but spaced from cutting edge 94 in a row of guard fingers 100. Fingers 100 prevent both the operator and customer from being cut by the blade and also serve as a comb for guiding strands of hair into the blade during use of the shaper 32.

Figure 8:
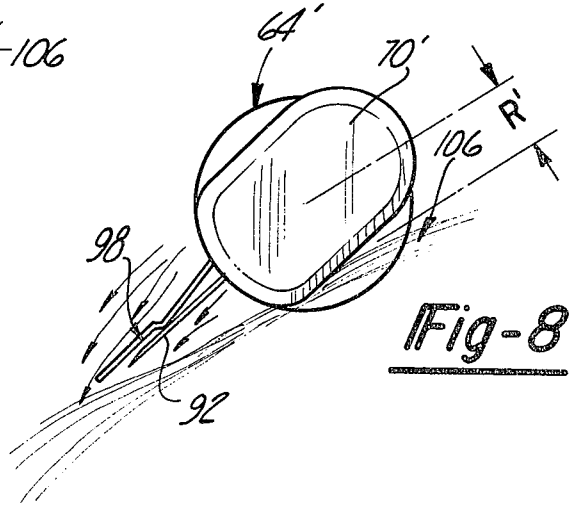
FIG. 8 is a view similar to that of FIG. 7 but illustrating the use of the device having the modified head of FIGS. 9 and 10.
Figure 7:
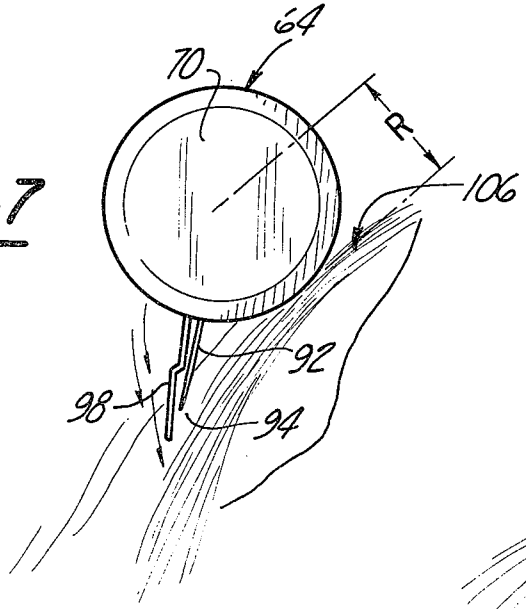
FIG. 7 is an end view looking at the free end of the hair shaping implement of FIGS. 1-6, the same being shown in use cutting and blowing hair while the shaper head is hand guided along the hair on the head of a customer on whom the method is being performed.
Figure 9:
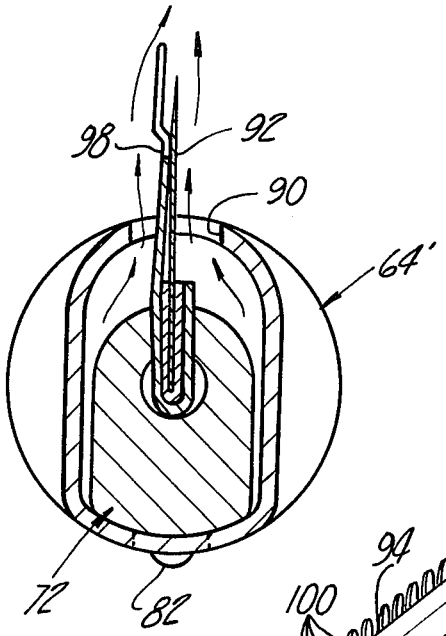
FIG. 9 is a cross-sectional view similar to that of FIG. 4 but looking in the opposite direction, illustrating a modified embodiment of the head of the hair shaping implement of the invention.
Figure 10:
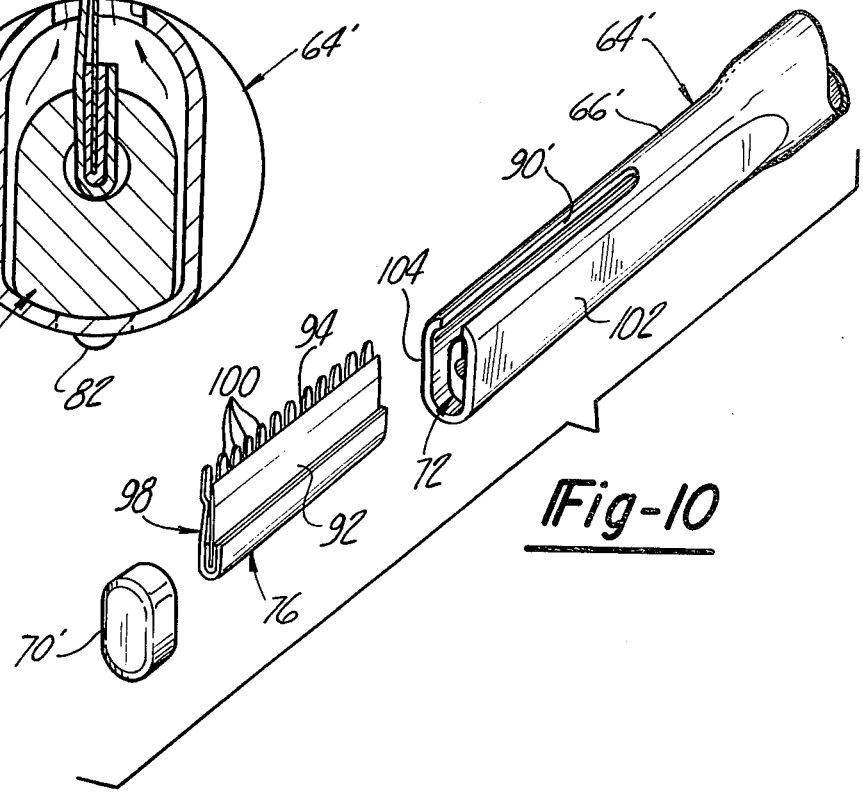
FIG. 10 is an exploded perspective view of the head, blade and holder elements of the modified embodiment of FIGS. 8 and 9.

In the modified embodiment illustrated in FIGS. 8, 9 and 10, identical elements are given the same reference numerals and corresponding elements are given a corresponding reference numeral with a prime suffix. In this modification, the principal difference resides in the shape of head 64' which, instead of being cylindrical, is flattened on opposite sides for about three-quarters of its length running from the free end backwardly toward handle 56. These flats 102 and 104 (FIG. 10) thus impart an oval or oblong cross-sectional shape to housing 66'. The end cap 70' is likewise made oblong in shape to fit this change in contour. Slot 90' is thus located between the flatted sides 102 and 104 and extends to the free end of housing 66'. Blade 92 and guard 98 protrude through slot 90' in the same manner as with housing 66. As best seen by comparing FIG. 7 to FIG. 8, the radial dimension R of the cylindrical housing 66 is greater than the corresponding dimension R' of the flattened housing 66'. Hence, when a hair shaping implement 32 equipped with head 64' is brought against the mat of hair 106 of the customer upon which the hairstyling method of the invention is being performed there is a shallower angle of attack or inclination of blade 92 relative to the hair surface defined by the matted hair 106 (FIG. 8) than is the case when head 64 is being stroked along the mat of hair 106 (FIG. 7).

In use, the above-described hair shaping apparatus of the invention is well adapted to perform the hair shaping method of the invention, as will now be described. First, the customer (indicated at C in FIG. 1) is given the usual hair shampoo and rinse, and the hair is only partially dried, if at all, so that it retains a well-wetted moist characteristic. The customer is then moved to the styling chair and the hair stylist, beautician or barber (indicated O in FIG. 1) is ready to commence the composite hair shaping steps of the method of the invention. The hair shaping apparatus is readied for use by turning on the hair drying blower 20 and then allowed to warm up to bring the air temperature to the desired setting, which customarily will be approximately 150° F. at implement 32. The blower motor in dryer 20 thus generates a flow of relatively high velocity, low pressure air through outlet nozzle 24 which is conducted via flexible hose 30 into the air chamber of the hair shaping implement 32. In FIG. 5 this air flow is indicated by the arrows in coupler 38, handle bore 60 and hollow interior of housing 66 which defines the air chamber around blade-guard 76. Thus, as shown by the arrows at A in FIG. 5, the heated air escapes in a steady stream which flows outwardly of head 64, the air issuing through slot 90 which serves as a means for directing the air in a stream over the surface of blade 92 and comb 98. Due to the flow of air within implement 32 being an axial flow, the air tends to blow diagonally across blade 92 and guard 98 as a column of air, the major portion of which flows at an angle to the longitudinal axis of head 64 of about 30 degrees. Due to the clearance between the blade holder 72 and interior wall 80 of housing 64 the air flows along either side of the holder down toward the remote end of the housing, where its exit is blocked by cap 70. The resulting back pressure generated at the downstream end of slot 90 in turn produces the 30 degree angulation of the air stream issuing from slot 90. Generally, the same air flow action occurs in the modified housing 64' of FIGS. 8–10.

With the apparatus conditioned and ready for use and running, as indicated above, the cosmetologist or barber O then grips the shaping implement 32 with one hand, generally as shown in FIG. 1, so that head 64 protrudes from the hand in a natural holding position. When gripped in this attitude, hose 30 will extend along and under the forearm F of the operator and thus will assume a position of minimum interference with the hose trailing along and behind the operator until it reaches its connection to the dryer 20. If desired, the hose may be suspended above the floor by suitably suspending the dryer 20 in an elevated position, either at counter height, shoulder height or above the operator.

Next, the operator manipulates the hair shaping implement 32 much in the manner of a conventional hair shaper, that is, the razor cutting blade 92 is brought against the hair 106 of the customer with the longitudinal axis of the holder generally flat against the matted hair surface and at a desired angle of approach. For example, when shaping men's hair along the sides of the head, where the hair tends to extend from front to rear, the operator manipulates implement 32 so as to move blade 92 rearwardly along the side of the head with blade 92 generally pointed inwardly toward the head at approximately the angle indicated in FIG. 7. The teeth 100 of guard 98 help guide hair into the cutting edge 94, but customarily the cutting action is also assisted by the operator using two fingers of his other, free hand extended so as to grasp a clump of hair therebetween to feed it into the blade while maintaining tension of the hair by letting it slip through the index and middle fingers of his free hand. Thus, it has been found that an operator already experienced with conventional razor cutting of hair, and with some practice and orientation, can readily adapt his already known techniques to the use of the hair shaping implement 32 of the invention with little difficulty and with only a short learning period required.

However, there are some differences in the manner of the blower-shaped 32 versus a conventional hair shaper due to the fact that with the invention there is now a constant stream of air (preferably hot air) issuing over the cutting blade 92. Because this air stream is flowing generally in the direction in which the cutting blade is being moved by the operator, it will blow the hair out ahead as it is being fed to the blade edge 94. Thus, the hair is not only subjected to the shaping action and force produced by the movement of blade 92 through the mat of hair, which is the customary shaping action, but it is also trained and oriented by a steady stream of hot air. This composite action greatly enhances the operator's ability to work the hair into the shape and style desired as he or she cuts and/or thins the hair.

Moreover, in the preferred embodiment of the hair shaping implement 32 illustrated in the drawings, in which there is an angulation of the major portion of the air stream at 30 to 45 degrees to the longitudinal axis of the implement 32, and toward and beyond the free end thereof, a horizontal fore to aft stroke of the hand to move the cutting blade in a horizontal direction (as when working the side of the head near the ears and temple, as illustrated in FIG. 1) can be employed and yet the major direction of movement and force imparted by the hot air stream will generally be in a vertical direction. In addition, the air stream will also be directed as well as at an angle inwardly toward the scalp as shown in FIG. 7 or FIG. 8. Hence, as the wet hair is being cut and/or thinned, it is forced inwardly toward the scalp and also lifted upwardly. Therefore, when the hair has dried and taken a permanent set it will have been placed in a position slightly above where it will eventually tend to fall by gravity, thereby insuring a longer lasting effect from the hairstyling or shaping treatment.

When the operator has completed one side of the head, such as the right-hand side of the customer, as shown in FIG. 1, the hair shaping implement 32 can remain in the right hand while the operator is shaping the left side of the head, or the operator may switch the shaper 32 to the left hand, as desired. The swivel connection provided between handle 56 and coupler 38 facilitates rotating shaper 32 about its axis without thereby imparting rotation to hose 30, making it that much easier to manipulate in the hand of the operator. If it is desired to impart a downward set as well as inward set to the hair, shaper 32 can be held such that head 64 is pointed downwardly rather than upwardly as viewed in FIG. 1. The flexibility and lightness of hose 30 readily accommodates orientation of shaper 32 in any desired attitude and permits the quick and deft movements necessary for efficient shaping of the more complicated hair coiffures. Due to the preferred connection of conduit 30 to head 64, i.e., via the interior of handle 56, the hose is trained in a position where it is least awkward, namely adjacent the forearm of the operator. Moreover, the normal razor cutting motion of shaper 32, which involves generally a back and forth movement of head 64, also requires a pivotal action of the wrist of the operator. However, with the hose coupled to the handle end of shaper 32, only a small portion of the hose 30 adjacent the end coupled to the hair shaping implement 32 is flexed in order to accommodate such cutting motion.

Once the operator has completed the hair shaping strokes around the head of hair, the hairdo will have assumed its final finished form because the hot air stream A will have also effected most if not all of the drying action which hitherto has been performed subsequent to the razor cutting of the hair. Moreover, the separate operations of blowing and combing hitherto performed on short hair are no longer necessary because the effect produced by these previous separate operations will have already been accomplished by the operator merely in performing the razor cutting step.

From the foregoing description it will not be apparent that the method and hair shaping apparatus of the present invention represent a substantial step forward in the hair styling beautification art. The conjoint performance of the razor cutting and/or thinning operation with the hair blowing of the hair enables both the customer and the cosmetologist to effect a significant saving in time because these operations no longer need be done sequentially. In addition, shaping or molding of of the hair into place as it is being cut can now be accomplished at the same time it is being thinned and/or cut because wet hair that is rapidly dried will tend to stay in place. An improved hair training and placement action is also now possible because the razor blade and air stream work together in shaping the hair. Blower-shaper 32 also enables the operator to layer or blunt cut the customer's hair in addition to thinning and/or shaping.

Another very important advantage of hair shaper 32 is the constant removal, by the air blast A, of the hair cuttings being generated by the cutting action of blade edge 94. In the past, it has been necessary when performing razor cutting to constantly halt the operation and to remove cut hair from the blade and guard. Other hair cuttings not so caught in the cutting blade either fall into the customer's hair or onto the neck, causing irritation to the customer. Hence, the constant removal of the hair cuttings by the air stream eliminates such annoyance of the customer and also enables the cosmetologist to work much faster. The air stream travelling over the shaper guard 98 also keeps guard 98 as well as the blade 92 constantly clean, enabling these elements to do a better job of cutting and/or thinning.

The ability to select a range of air stream temperatures enables the operator to select the appropriate shaping temperature for whatever effect he is intending to create in the hair style. For example, it is possible in performing the method of the invention with shaper 32 to use a specially formulated setting lotion that helps set the hair as it is being cut. Commercially available fast evaporating setting lotions which are designed to be used with heat work quite well with the combined shaping and hot air blowing method of the invention. For example, the specially formulated hair setting lotion sold under the brand name "LA MAUR I G S INSTANT CONDITIONER & SET", manufactured by La Maur, Inc., of Minneapolis, Minn., is one such lotion. By pretreating the customer's hair with a shampoo rinse and such a lotion, and then performing the hair shaping operation while the hair is wet with such lotion, a very fast evaporating action occurs which will enable the operator to impart greater curvature and fanciful effects to the hair being styled. The use of hot set lotions will also enable the hair to be set more permanently so that it will remain in the desired set for a longer period of time.

Another advantageous effect which is believed to occur from the method and apparatus of the invention is the reduction in split ends of the hair obtained by heating the hair as it is razor cut. As in conventional razor cutting, the cutting action of shaper 32, as blade 92 is moved along at a rather shallow angle relative to the axis of the hair, causes each hair to be cut diagonally at an angle or on a bias, which in turn would normally lead to the split end effect. However, with the hair being wet, and with the hot air heating the hair just before it is cut and while it is being cut, and because the blade itself is kept heated by the hot air stream flowing over the blade, the ends of the hair may be sealed or cauterized as they are cut, thereby reducing or minimizing the tendency of the cut ends to split and produce undesirable frizzy effect.

Hair shaper 32 is also readily adjustable to change the orientation of the combined blade-guard 76. For some operators or cosmetologists, the instrument will be more convenient to operate with blade-guard 76 inclined all the way over to one side or the other of air slot 90. This range of adjustment is illustrated in FIG. 4 as indicated previously. The adjustment from one side to the other, or to the center position in FIG. 9, is readily effected by merely loosening the adjustment screws 82 and 84 and rotating the holder 72 within the housing 66, and then retightening the screws. This is also a convenient way to change over the instrument for left-hand or right-hand operation, depending upon the needs or desires of the operator. If it is desired to switch the blade-guard 76 from one side of slot 90 to the other, and yet keep blade 92 between guard 98 and the hair being shaped, blade-guard 76 can be reversed in position in holder 72. In the case of embodiment of the shaper 32 of FIGS. 1–7, this is accomplished by removing the screws 82 and 84, allowing the holder 72 to be slid lengthwise down the passage 60 while blade-guard 76 is restrained in place by the end edge of slot 90 until the blade-guard 76 has been slid completely out of the holder slot 74. Blade-guard 76 can then be removed from housing 66 via slot 90, turned around, repositioned in slot 90 and then reinserted endwise into holder slot 74 by moving the holder 72 back into its normal position. With modified head 64' of FIGS. 8–10, this operation is facilitated by having slot 90 extend to the end of the housing 66' as best seen in FIG. 10. Hence, blade-guard 76 can be slid out of holder 72 without loosening the screws 82–84 merely by removing the end cap 70', then reversed end for end and slipped back into holder 72.

It will also be understood that the heating and hair blowing action imparted by the air stream A issuing through slot 90 or 90' has been found to be preferably oriented with the majority of the air stream directed to flow along the guard side of blade-guard 76. However, as indicated in FIGS. 7 and 8, and more particularly in FIG. 9, good results can also be obtained with air stream divided so as to issue on both sides of the blade-guard 76, or even with the majority of the air issuing on the blade side of blade-guard 76. It is also to be understood that although the housing 64 and 64' are shown constructed of metal, such as aluminum, the entire unit may be made of plastic materials with the blade holder 72 formed integrally with the housing.

I claim:

1. A method of shaping human hair to provide a particular hairstyling effect or hairdo comprising the steps of:

(a) conditioning the hair by moistening the hair in order to impart a predetermined degree of moisture content in the hair to be shaped;

(b) moving a hair shaping razor cutting blade having a single fixed linear cutting edge through the moist hair to razor cut and/or thin the hair with the blade being manipulated such that the hair is trained into a predetermined set position while the same is being cut and/or thinned; and (c) simultaneously with the performance of step (b) causing a stream of air to be directed across the blade generally in the direction of movement of the blade such that the air stream moves out ahead of the cutting blade after sweeping the same into the hair being approached by said cutting edge to thereby help train said hair into the afore-mentioned predetermined set position while at least semidrying the moisture from the hair, whereby upon completion of step (b) the conjoint effect of steps (b) and (c) results in the hair being shaped into final placement for the desired hairstyle or hairdo.

2. The method as set forth in claim 1 wherein the hair is cut by causing the blade to move along and adjacent to the scalp in a generally horizontal direction while the air stream is caused to issue over the blade at an angle inclined upwardly from the horizontal so as to lift said hair as the same is being shaped, cut and dried.

3. The method set forth in claim 2 wherein said air stream is oriented so as to be directed at an angle inwardly toward the scalp at a slight angle to the forward motion of the cutting blade to thereby cause the hair to be forced inwardly toward the scalp as the same is being cut and/or thinned by the motion of the blade through the hair.

4. A hair shaping apparatus comprising in combination a source of relatively high velocity, low pressure air, an air conduit having one end connected to the source and the other end communicating with an air-orienting chamber, a hair shaping head associated with said air chamber and having a hair shaping razor blade mounted therein having a single fixed linear cutting edge, said head having orifice means with said blade protruding from said head in the vicinity of said orifice means, said blade having said cutting edge exposed beyond said head, said orifice means being arranged and constructed relative to said blade for directing the flow of air from said source via said air chamber such that an air stream is provided along the blade which flows generally in the direction in which the head is moved when cutting hair and outwardly past the knife edge of said blade after sweeping the same and thence into the hair being approached by said cutting edge, said head including a handle and said head and handle being generally tubular and coaxial, said head being connected at one end to the end of said handle and said air conduit being connected to an end of said handle opposite said one end whereby said handle and head form an air passage communicating said air conduit with said air chamber, said air chamber comprising a hollow interior passage in said head, said head orifice means comprising an elongated axially extending slot in said head communicating the interior of said passage with the exterior of said tubular head, said hair cutting blade being mounted generally at the downstream terminous of said passage of said tubular head and protruding into the path of the said stream issuing through said slot, said hair cutting blade having a comb-like guard associated therewith disposed adjacent said blade with a series of fingers protruding beyond the free cutting edge of the blade, said head further including blade holder means having a groove adapted to slidably receive endwise said blade therein to thereby removably mount said blade in said head, said blade holder being adjustably mounted in said passage to permit adjustable orientation of said blade throughout a range of angular movement from one side of said slot to the other, said slot extending to the free end of said tubular head, said passage opening to the free end of said tubular head and being closed by a removable end cap such that said blade is removable endwise from said holder upon removal of said end cap from said tubular head.

* * * * *